United States Patent [19]

Cunningham et al.

[11] Patent Number: 4,472,864

[45] Date of Patent: Sep. 25, 1984

[54] FEEDER FOR TENTERS

[75] Inventors: Wallace Cunningham, Newton Mearns; Alexander Sclater, Barrhead, both of Scotland

[73] Assignee: Proctor & Schwartz, Inc., Horsham, Pa.

[21] Appl. No.: 451,359

[22] Filed: Dec. 20, 1982

Related U.S. Application Data

[63] Continuation of Ser. No. 178,454, Aug. 15, 1980, abandoned, which is a continuation-in-part of Ser. No. 970,757, Dec. 18, 1978, abandoned.

[30] Foreign Application Priority Data

May 31, 1978 [GB] United Kingdom ..... 25384/78

[51] Int. Cl.[3] ..... D06C 3/04

[52] U.S. Cl. ..... 26/89; 226/172; 271/275

[58] Field of Search ..... 26/87, 88, 89, 96, 98; 83/102, 106, 151, 155, 288; 226/171, 172, 176; 271/275

[56] References Cited

U.S. PATENT DOCUMENTS

| | | | |
|---|---|---|---|
| 2,848,779 | 8/1958 | Scarbrough | 26/105 X |
| 2,988,772 | 6/1961 | Horn | 26/88 X |
| 3,177,746 | 4/1965 | Langer | 83/151 X |
| 3,335,625 | 8/1967 | Kluth | 83/106 X |
| 3,747,918 | 7/1973 | Margulis et al. | 271/275 X |
| 3,941,376 | 3/1976 | Liechty et al. | 271/275 |
| 3,944,214 | 3/1976 | Fallos et al. | 271/275 X |
| 4,009,877 | 3/1977 | Ward, Jr. | 271/264 X |
| 4,145,041 | 3/1979 | Kew | 271/275 X |
| 4,173,611 | 11/1979 | Benson et al. | 26/89 X |
| 4,190,185 | 2/1980 | Thate | 271/274 X |
| 4,210,987 | 7/1980 | Benson et al. | 26/89 |

*Primary Examiner*—Robert Mackey
*Attorney, Agent, or Firm*—Richard H. Thomas

[57] ABSTRACT

The present invention relates to a feed device for continuously feeding strips of material to processing apparatus, and in particular to a feed device for feeding polymer film onto film tenter apparatus. The present invention comprises a pair of endless belts disposed along opposite sides of the path of travel of the polymer film, and cooperating substantially frictionless supports on which the film edges ride, pressed between the belts and said supports. Each endless belt has a lower run which extends between spaced idler pulleys, and means are provided for maintaining the belt full lower run in continuous frictional contact on the advancing polymer film.

13 Claims, 14 Drawing Figures

FEEDER FOR TENTERS

This application is a continuation of application Ser. No. 178,454 filed Aug. 15, 1980, now abandoned, which application is a continuation-in-part of application Ser. No. 970,757 filed Dec. 18, 1978, also abandoned.

The present invention relates to feed devices for guiding and feeding continuous strips of material to processing apparatus. The present invention will be described particularly with respect to feed devices for feeding and guiding polymer film onto film tenters, but it will be apparent to those skilled in the art that the present invention has other applications.

BACKGROUND OF THE INVENTION

The production of polymer film, for instance polyethylene terephthalate film, involves a sequence of process steps which includes the extrusion of the molten resin in the form of a film, quenching the extruded film, and thereafter sequentially stretching the film in both the longitudinal and transverse directions. For this purpose, a polymer film orientation line generally will comprise an extruder, casting rolls and forward draw rolls followed by textile-type tenter apparatus in which transverse stretching at elevated temperature occurs. A feature of presentday lines is that they operate at very high speeds, frequently by way of example, in excess of 200 meters per minute.

A critical step in polymer film production is proper orientation of the cast and drawn film in the tenter apparatus, and in particular proper introduction of the cast and drawn film into the tenter clips. In operation, it is impractical to stop the line to insert the film into the tenter clips. It is possible to reduce line speed, but this reduction is limited by equipment and process reasons such that in high speed lines the minimum speed available for threading film into the tenter clips is still dangerously high.

It is known to provide an accumulator system to substantially slow down the lineal speed of the film so that it may be safely and accurately positioned in the tenter apparatus clips, but this requires the use of complicated and unduly expensive equipment.

Another problem unique to polymer films, not experienced with conventional webs, is the difficulty in engaging the polymer film with a feed device. It is undesirable to puncture the film with conventional threading devices, and polymer films have slippery or relatively frictionless surfaces which make engagement with other devices relatively difficult.

SUMMARY OF THE INVENTION

According to one aspect of the present invention, there is provided apparatus for advancing a continuous web of material comprising a pair of endless belts disposed along opposite sides of the path of travel of such web, low friction support means on which the web edges ride, said support means cooperating with the endless belts to press the web therebetween, means to exert a downward pressure of said belts on said web, means to advance said belts in the direction of travel of the web, said downward pressure being sufficient to develop a frictional engagement between the belts and web, in turn sufficient to advance the web, and means to limit said downward pressure to limit the frictional resistance of said cooperating surfaces on the web.

Preferably the belts are toothed timing belts to prevent relative slippage between drive means for the belts and the belts themselves.

In a preferred embodiment of the present invention, there is provided a support means for the spaced pulleys including a first frame means extending from a pivot center to the first of said pulleys; and a second frame means extending from the first of said pulleys to the second pulley, said second frame means being pivotally mounted with respect to said first frame means and including a plate member conforming to each substantially frictionless surface and positioned to exert a downward pressure on a belt lower run.

According to another aspect of the present invention, there is provided web advancing apparatus for advancing a continuous web of material comprising a pair of endless belts, a pair of first and second pulley means for each of said belts defining belt lower runs disposed along opposite sides of the path of travel of said web, means to advance said belt lower runs in the direction of travel of said web, cooperating low friction support means on which the web edges ride, said support means and belt lower runs pressing the web edges therebetween, support means for each pair of pulley means including a first frame means extending from a pivot center to the first of said pulley means, and a second frame means extending from the first of said pulley means to the second of said pulley means, said second frame means being pivotally mounted with respect to said first frame means and including a plate member conforming to said cooperating surface and positioned to exert a downward pressure on said belt lower run.

The invention and advantages thereof will become apparent upon consideration of the following specification, with reference to the accompanying drawings, in which.

Figure 1:
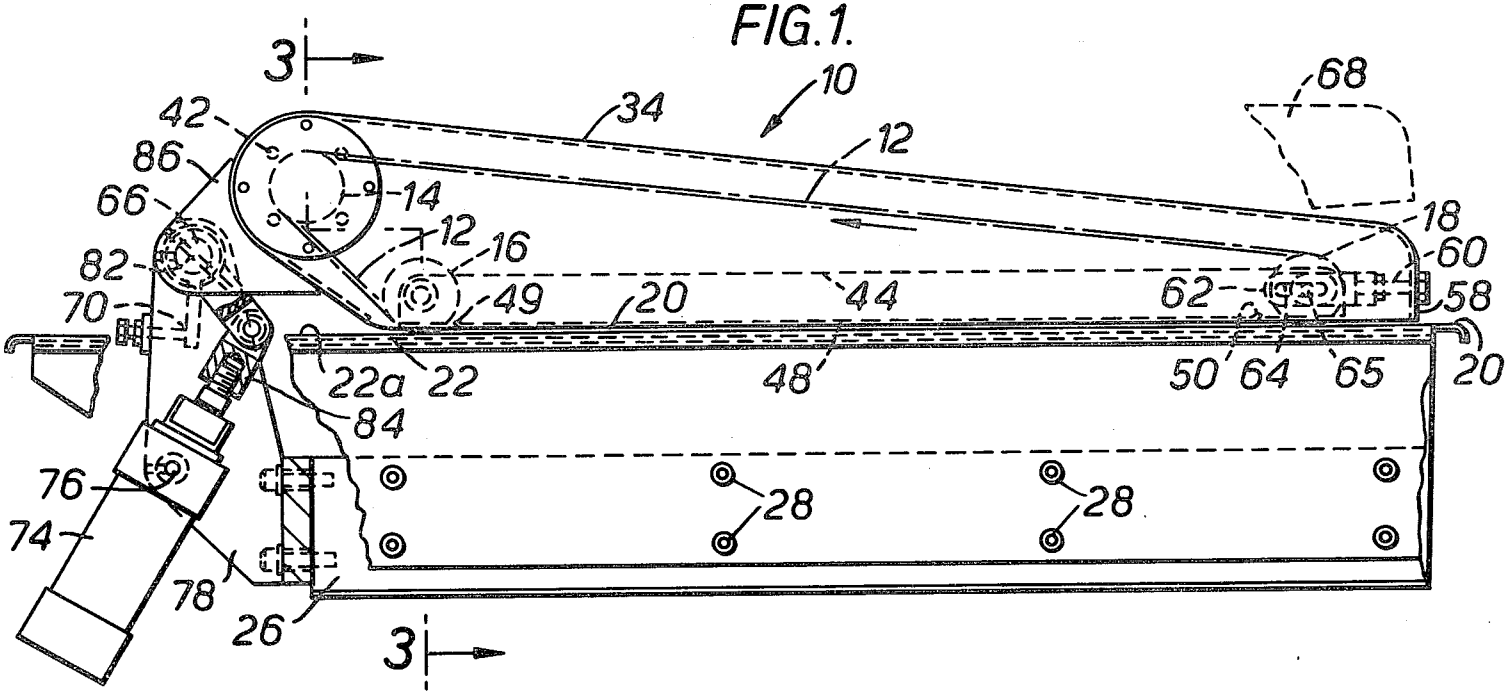
FIG. 1 is a partial section elevation view of the feed device in accordance with the concepts of the present invention.
Figure 3:
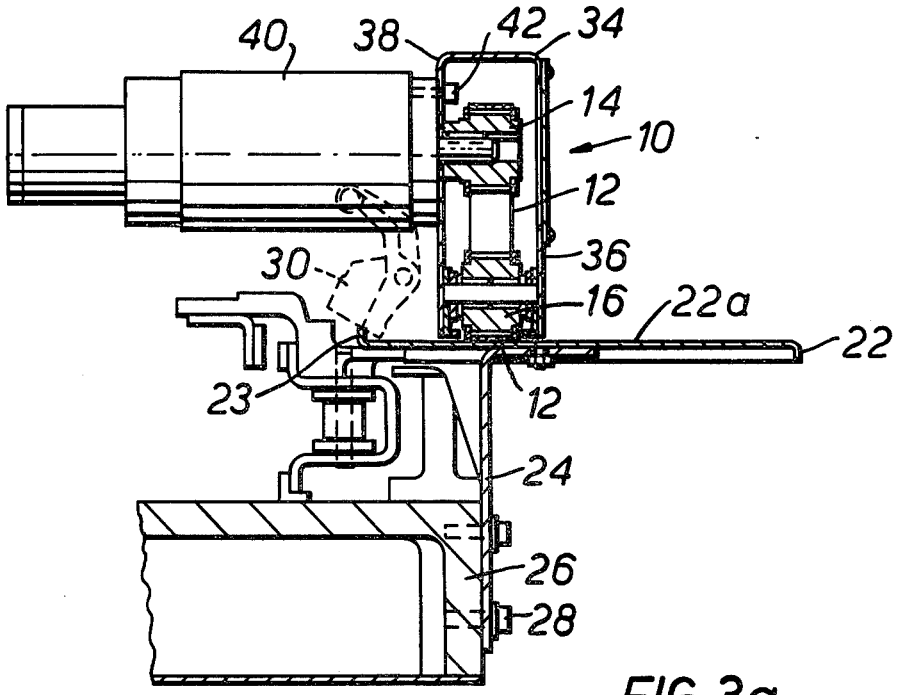
FIG. 3 is a section view taken through line 3—3 of FIG. 1.
Figure 3A:
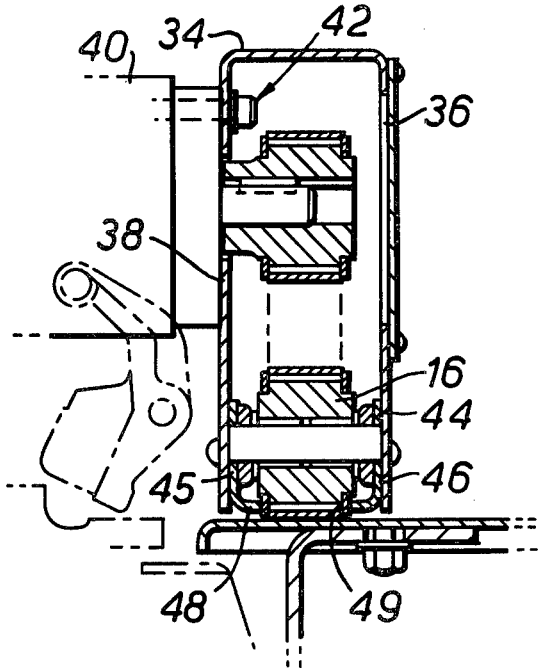
Figure 4:
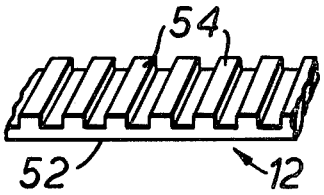
Figure 5:
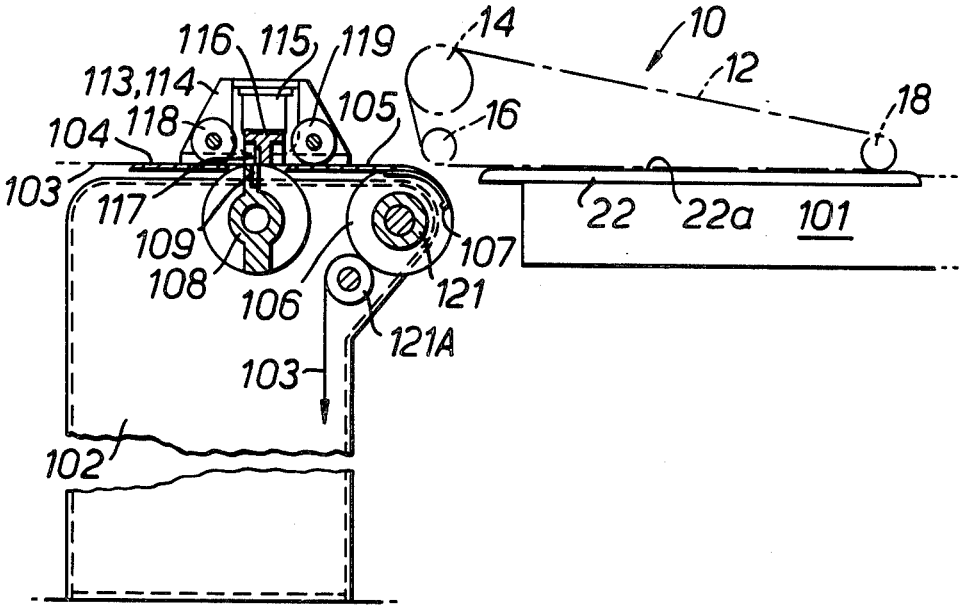
Figure 6:
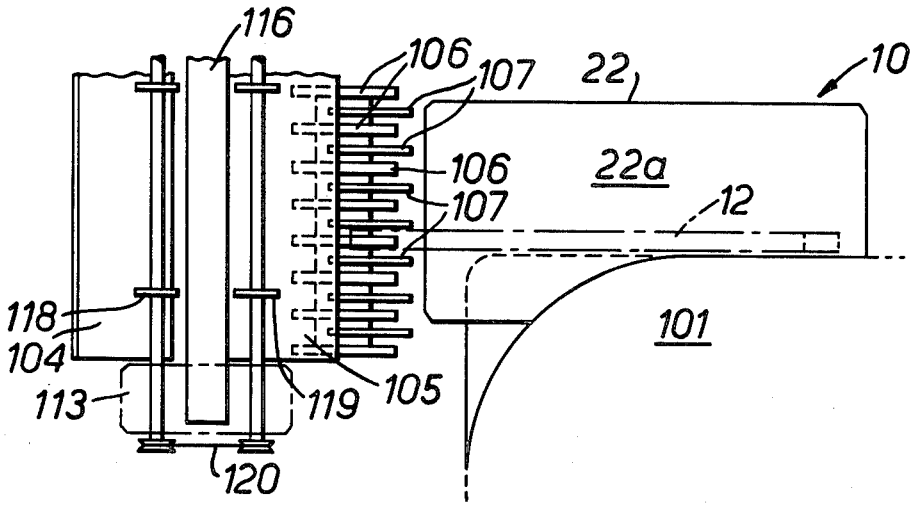
Figure 7:
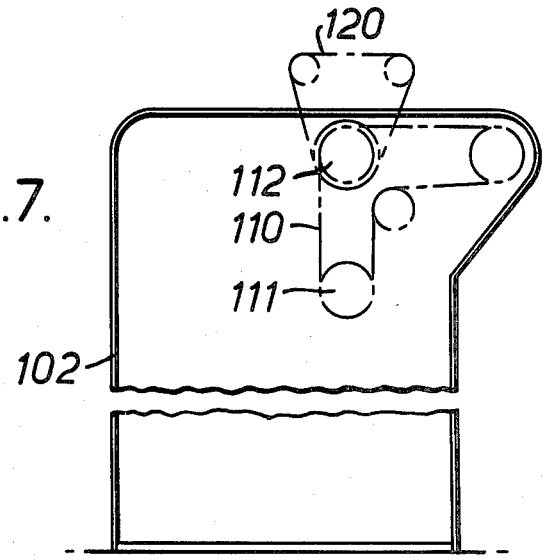
Figure 8:
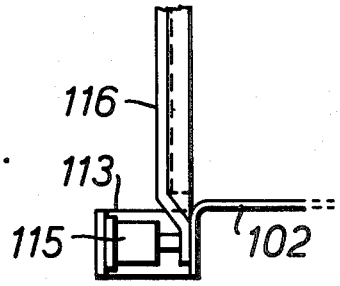
Figure 9:
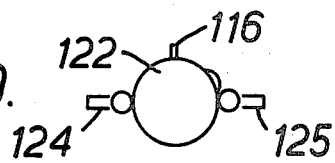
Figure 10:
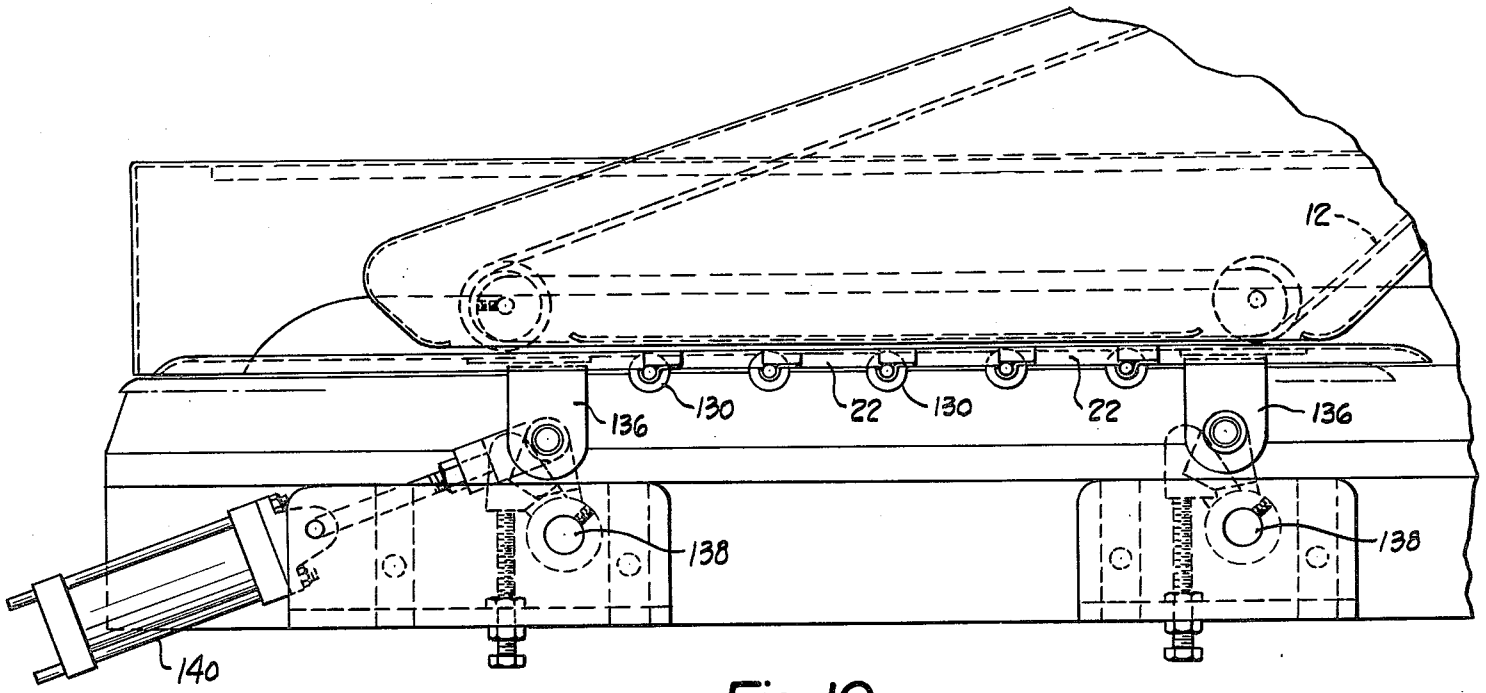
Figure 11:
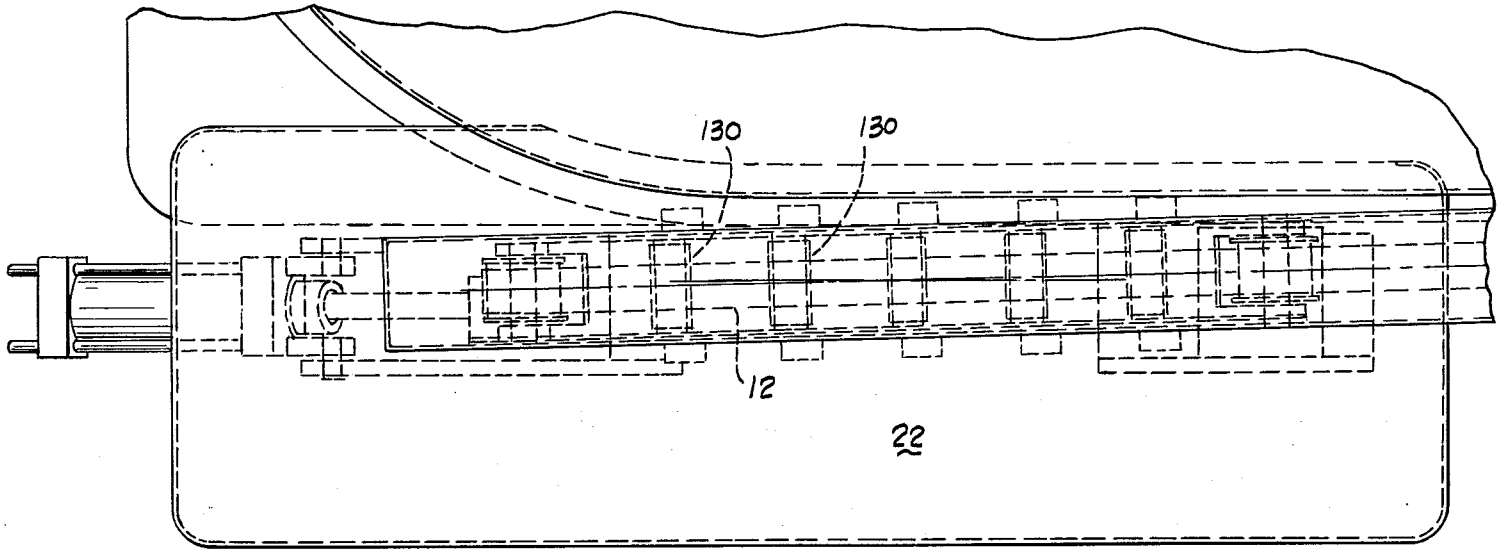
Figure 12:
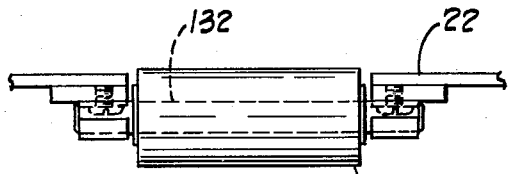
Figure 13:
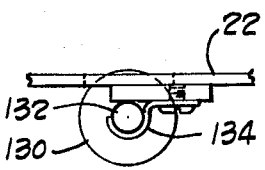

FIG. 3*a* is an enlargement of a portion of FIG. 3;

FIG. 4 is an enlarged perspective view of a timing belt employed in the feed device of FIG. 1;

FIG. 5 shows a schematic side view of cutting apparatus for use with the feed device;

FIG. 6 shows a plan view of the cutting apparatus of FIG. 5;

FIG. 7 shows a schematic side view of the drive of the cutting apparatus of FIGS. 5 and 6;

FIG. 8 shows an end view of part of the stationary blade carrier of the cutting apparatus;

FIG. 9 shows the rotating cam timing mechanism;

FIG. 10 illustrates an embodiment in accordance with the concept of the present invention;

FIG. 11 is a plan view of the apparatus of FIG. 10;

FIG. 12 is an enlarged elevation view of a part of the apparatus of FIG. 10; and FIG. 13 is a side view of the apparatus of FIG. 12.

In FIGS. 1–4 in the drawings, there is illustrated only a left-hand unit of the feed device of the present invention engaging the left-hand side of an advancing polymer film. It should be understood that the feed device of the present invention incorporates both right- and left-hand units, each independently driven and attached to a respective entry rail of the tenter frame. The right-hand unit is the same as the left-hand unit, but a mirror image thereof.

Turning to the drawings, the feed device 10 of the present invention comprises an endless belt 12 which, as shown in FIG. 1, travels around a motor pulley 14 and two spaced-apart idler pulleys 16 and 18, defining a triangular configuration. The idler pulleys 16 and 18 establish a lower run 20 for the belt. Cooperating with this lower run is a plate 22 having an upper polished surface 22*a* which may be polished metal, or coated with a low friction material such as polytetrafluoroethylene. Alternatively, the plate 22 can be made from molded low friction plastic.

Figure 2:
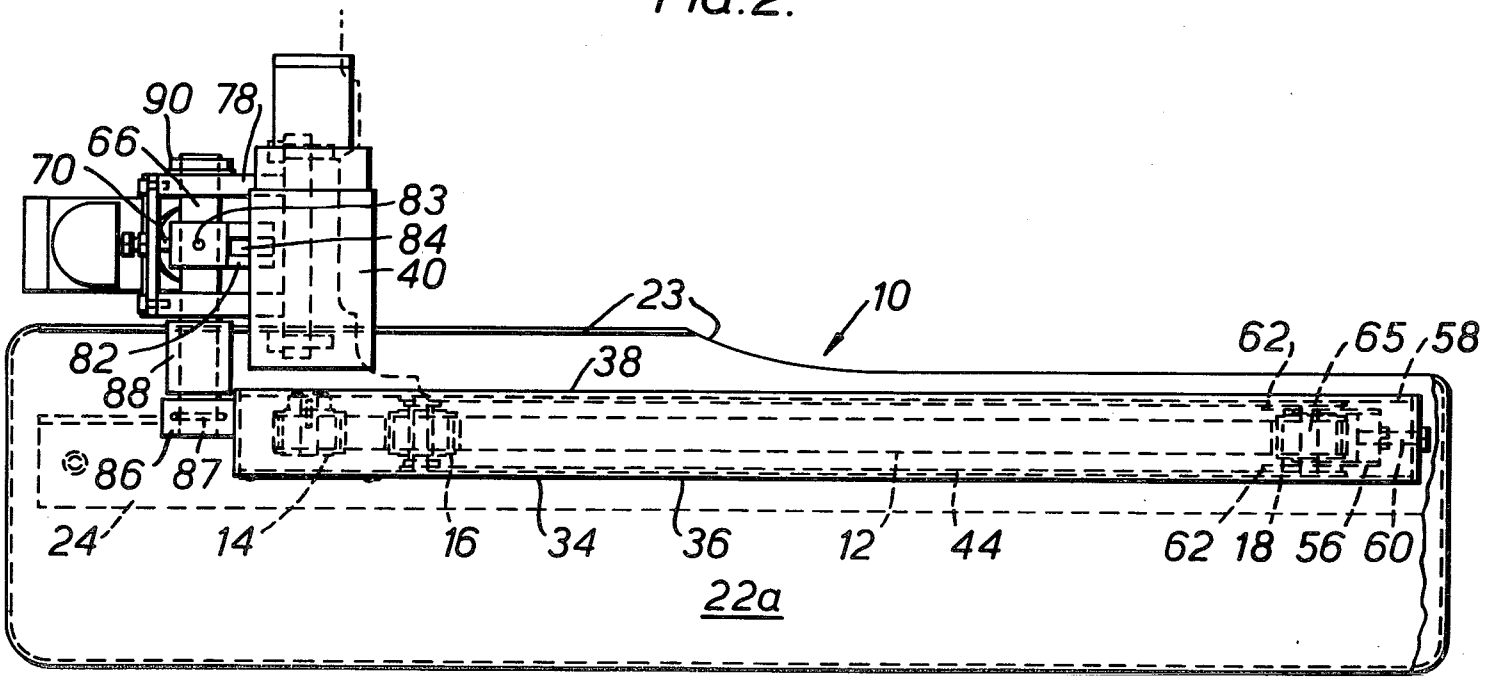
FIG. 2 is a plan view of the feed device of FIG. 1.

Details of the plate are best shown in FIGS. 2 and 3. The plate is a generally flat member which is contoured along its inner edge 23, and is supported in the horizontal position by a vertically extending bracket 24 which is attached to entry rail 26 of the tenter apparatus. Attachment is by clamping screws 28 which permits vertical adjustment of the plate so that the polished surface 22*a* is at clip platform height for tenter clips 30, shown in phantom lines in FIG. 3. The profiling of the plate, along inner edge 23, is such that it extends adjacent to the clip platforms for the tenter clips before the same pass into the vicinity of the film edge, engaged by the belt lower run 20, in their ordinary path of travel. In this way, the film edge of softly transferred from the feed device of the present invention to the tenter clips.

Referring back to FIG. 1, the belt motor pulley 14 and idler pulleys 16 and 18, arranged in a triangular fashion, define a path of travel for the belt such that the belt outer surface forms an acute angle with the polished surface 22*a* when between the motor pulley 14 and the first idler pulley 16. When between the first idler pulley 16 and the second idler pulley 18, the belt outer surface lies parallel to and against the polished surface 22*a*. Holding the respective pulleys in the triangular configuration is a main housing 34 or first frame means which also has a generally triangular shape. This housing is an inverted U-shaped member, as best shown in FIG. 3*a*, which is open at the bottom and has sides 36 and 38, side 38 supporting a motor housing 40 by means of clamping screws 42. A second frame means or U-shaped or folded channel 44 floats in the bottom of the main housing 34. This channel is provided with sides 45 and 46 which act as supports for the spaced-apart idlers 16 and 18. As shown in FIG. 3*a*, the folded channel 44 is provided with a closed bottom 48 which extends between the sides 45 and 46, except at the ends of the channel wherein it is slotted, at slots 49 and 50 (notice FIG. 1), to accommodate idler pulleys 16 and 18.

The endless belt 12 (FIG. 4) is preferably a toothed endless timing belt which has a flattened outer surface 52. The motor pulley 14 is provided with cooperating teeth (not shown) which engage the teeth 54 of the belt 12. In operation, the belt is driven in a counter-clockwise direction (with reference to FIG. 1), and it passes around forward idler pulley 16 underneath the bottom 48 of the folded channel 44 and around idler pulley 18. Thus, the folded channel, for the bulk of the run between the idler pulleys 16 and 18, bears against the belt pressing it uniformly downwardly against the polished surface 22*a*, or against the film riding on such surface.

FIGS. 1 and 2 illustrate the manner in which the folded channel is supported within the main housing 34. In essence, there is provided a bracket 56 (FIG. 2) which is fastened to the main housing end 58 by means of an adjusting screw 60. The bracket 56 in turn provides a pivotable support for idler pulley 18 and folded channel 44. This is accomplished by providing slotted brackets 62, slotted at 64, fastened to the inner sides of the folded channel, shaft 65 for the idler pulley 18 riding in slots 64. These slots permit the channel to move slightly longitudinally or horizontally with regard to the main housing 34 and idler pulley 18.

Tension of the timing belt 12 is maintained by adjustment of adjusting screw 60, engaging the shaft 65 of the idler pulley 18 through bracket 56.

The entire feed device, including the main housing 34, drive and idler pulleys 14, 16 and 18, belt 12, and folded channel 44 are capable of being raised away from the polished surface 22*a* around pivot center 66 (FIG. 1), from a working position, as shown, to a clear position 68 shown in phantom lines. When in the working position, an adjustable stop 70 takes the weight of the housing 34 and motor, so that the weight bearing on the lower run 20 of the endless belt 12 consists essentially of the weight of the folded channel 44. This limits the bearing pressure of the belt 12 against the polished surface 22*a*, or against a film riding on the polished surface, and makes adjustment of stop 70 less critical.

Raising the main housing and associated apparatus to a clear position is accomplished by means of pneumatic cylinder 74 acting about pivot 76 supported on a yoke 78 affixed to the front of entry rail 26 of the tenter apparatus. Also supported by the yoke 78, above pivot 76, is pivot shaft (or center) 66. This pivot shaft is rigidly fastened to clevis 82, by means of pin 83, the clevis in turn being pivotally fastened, at its free end, to arm 84 of the pneumatic cylinder 74. In this way, extension of the pneumatic cylinder 74, and upward movement of arm 84, causes upward movement of clevis 82 and rotation of the pivot shaft 66 in yoke 78.

The pivot shaft also is fixedly connected to bracket 86, by means of pin 87. The bracket 86 in turn is welded or otherwise fastened to the front of main housing 34, such that on rotation of the pivot shaft 66, the housing 34 is raised to the phantom position 68 shown in FIG. 1. Spacer 88 maintains accurate spacing of the feed device (housing 34) with regard to the yoke 78, collar 90 holding shaft 66 on the yoke 78.

Advantages of the present invention should be apparent. Primarily, the feed device of the present invention is readily raised and lowered from a working position to a clear position and vice versa. At the same time, when in the working position, the pressure exerted by the timer belts on the advancing film is maintained at an adequate amount to frictionally engage the film, but is limited to avoid excessive resisting friction by the plate 22. In this regard, resisting friction is minimized by employing a polished upper surface or a material such as polytetrafluoroethylene on which the film rides. Frictional contact between the belt and film is assured by means for maintaining the entire lower run of the belt (folded channel 44) in contact with the film. A uniform or desired speed of the belt is assured by employing a toothed timing belt, as described.

In operation, the speed of the drive motor 40 can be controlled by employing a direct current range drive and a known tachometer feedback. In certain applications it may be desirable to employ a constant torque drive, and thus constant tension in the advancing film. In such applications, permanent magnet direct current motors have been found to be suitable.

A number of different materials can be employed for manufacture of belt 12. Rubber has been found to be one suitable material for good frictional engagement between the belt and advancing film.

FIGS. 5 to 9 show the preliminary automatic cutting apparatus 100 for cutting the initial length of unsuitable film from the fed strip so that only film suitable for transverse orientation in the tenter proceeds to the feed device 10. As can be seen in FIGS. 5 and 7, the cutting apparatus is located immediately upstream of the feed device 10 and these figures show the location of the device 10 at the end of the tenter entry rail 101.

The cutting apparatus includes right- and left-hand consoles 102 (for the respective sides of the tenter frame and only one is shown in FIGS. 5 to 9), and film 103 is received by the consoles from for example longitudinal stretching rolls, and initially the film 103 is fed over slide plates 104, 105 and around arcuate support means defined by discs 106 (see FIG. 7) and interleaved flat sectioned finger springs 107, and subsequently the film is wound on the so-called "scrap winder"0 (not shown) or is chopped and delivered to a waste bin on a lower floor until the preceding operation is settled and film suitable for transverse orientation in the tenter is being produced: at that time by suitable operation of control means, the cutting apparatus cuts the film across its width and the freshly fed film is subsequently delivered to the feed device 10. The fresh film is initially fed by hand to the nip of the feed device 10.

The right- and left-hand consoles are arranged to carry a rotary cutter carrier 108 for cutter blade 109 which carrier is rotated by, e.g., timing belt 110, drive pulley 111 and driven pulley 112. Also carried transversely by the consoles are the slide plates 104 and 105. Cast iron brackets 113 and 114 are mounted one on each console and themselves support short stroke pneumatic cylinders 115, which serve to carry the transverse stationary blade carrier 116 and blade 117. Also carried by brackets 113 and 114 are spring-loaded feed rollers 118 and 119 driven by belt drive 120.

A shaft 121 carrying spaced aluminum discs 106 is also rotated by timing belt 110. Spring-loaded nip-roller 121A serves to maintain tension in film 103.

The flat section finger springs 107 are attached to the trailing edge of slide plate 105 and between the discs 106 of shaft 121.

A rotating cam 122 (see FIG. 9) is mounted on a shaft extension of rotating cutter carrier 108. Cam operated electric switches 124 and 125 serve to raise and lower the stationary blade carrier 116.

In the first phase of operation, film 103 is led through the open cutter and around arcuate means 106, 107 to scrap winder or chopper. The driven motor may be integrated into the range drive. In this condition, the rotating blade carrier 108 is operating at film speed but rotates clear of the underside of the film passing over the slide plates 104 and 105. When the switches 124 and 125 are energized by push button, then the lobe of cam 122 on striking relay switch 124 in turn operates a related solenoid pneumatic valve to cause the stationary blade carrier 116 to come to the lower position. The rotating blade 109 is shown lagging 120° behind the operation of the "down " switch. After 180° rotation, the relay switch 125 is operated by the cam 122 causing the stationary blade carrier 116 to be raised. The blade 109 may be helical and occupy less than 60° of the circumference with the various angular disposition selected in this example. When one cycle of the above cutting operation is performed the switching system 124 and 125 is de-energized and requires re-setting for a repeat performance.

When the film has been cut the feed rollers 118 and 119 serve to convey the new leading edge of the film onwards. Because tension is not then maintained, holding down spring fingers 107 are able to move to the horizontal position consequently raising the film leading edge to come into contact with the endless belt feeder 12 thus carrying it forward to be taken over by the clips of the tenter chain.

The complete assembly of the cutter is suitably mounted on a baseplate so that its distance from the rail end can be accurately located to take account of rail expansion at the time of thread-up.

In the embodiment of FIG. 10, there is provided a series of small polyamide idler rolls 130 which are imbedded in or protrude through the plate 22 so as to extend slightly above the upper surface of the plate. Thus, the advancing web is gripped in the nip between the idler rolls and the endless belts 12. As shown in FIG. 11, the idler rolls are slightly askew, with regard to the direction of advancement of the advancing web, so as to encourage movement of the advancing web toward the apparatus tenter clips.

FIGS. 12 and 13 are enlarged elevation and side views of the idler rolls showing details of the rolls. The rolls simply rotate on stationary axles 132 which are engaged at their ends by gutter clips 134 affixed to the underside of plate 22.

In this embodiment of the present invention, the endless belts 12 are the same as in the embodiment of FIGS. 1–4.

Preferably, the plate 22 is adapted for movement downwardly clear of the advancing web when the tenter machine is threaded up and running normally; that is when the feeder of the present invention is not in use. This is accomplished by mounting the plate 22 on a set of parallel links 136, the links in turn being mounted on bearing centers 138 for rotation thereabouts. The links are turned in a counter-clockwise direction by means of an air cylinder means 140, so that retraction of the air cylinder causes the plate 22 to move downwardly. This movement is timed to coincide with actuation of pneumatic cylinder 74 adapted to move the endless belts upwardly and out of engagement with the advancing web.

What we claim is:

1. A tenter having movable gripping elements which serve to grip opposite edges of a continuous web of polymeric material for movement of the web, and gripping means for advancing the continuous web of polymeric material at high speed with proper orientation to said gripping elements, said gripping means comprising:

a pair of endless belts disposed adjacent opposite longitudinal marginal edge portions of the web confined to said edge portions and extending in the direction of travel of such web;

low friction support means having co-operating surfaces on which the web edges ride, and comprising a plate member extending beyond the point of gripping of the gripping elements, said support means co-operating with a first run of the endless belts to press the marginal edge portions of the polymeric web therebetween and being adapted to maintain gripping of the web edges beyond the point of gripping by the gripping elements;

drive means engaging the endless belts to advance said belts first run in the direction of travel of the web;

pressure reacting means to exert a substantially uniformly distributed downward pressure along the length of said first run of said belts on said web edge portions;

said downward pressure being sufficient to develop a frictional engagement between the belts and web, in turn sufficient to advance the web;

means to limit said downward pressure to limit the frictional resistance of said co-operating surfaces on the web; and means displaceable in a direction normal to the film providing a floating relationship between the low friction support means and the pressure reacting means.

2. A tenter having movable gripping elements which serve to grip opposite edges of a continuous web of polymeric material for movement of the web, and apparatus for advancing the continuous web of polymeric material at high speed with proper orientation to said gripping elements, said advancing apparatus comprising:

a pair of endless belts disposed adjacent opposite longitudinal marginal edge portions of the web confined to said edge portions and extending in the direction of travel of such web;

low friction plate support means having co-operating surfaces on which the web edges ride, said plate support means co-operating with the endless belts to press the marginal edge portions of the polymeric web therebetween and being adapted to maintain gripping of the web edges beyond the point of gripping by the gripping elements;

means to exert a substantially uniform downward pressure along the length of said belts on said web edge portions;

means to advance said belts in the direction of travel of the web, said downward pressure being sufficient to develop a frictional engagement between the belts and web, in turn sufficient to advance the web; and means to limit said downward pressure to limit the frictional resistance of said co-operating surfaces on the web;

said means to exert downward pressure of the belts on the web edge portions comprising upper plate means bearing against the belt sides opposite the sides engaging the web edge portions, said advancing apparatus further comprising means floatingly supporting said upper plate means relative to the paths of travel of the endless belts whereby the weight bearing on the endless belts consists essentially of the weight of said upper plate means.

3. Apparatus of claim 2, including means to move said low friction support means out of the path of travel of the web.

4. Web advancing apparatus as claimed in claim 2, wherein said belts have a rubber surface engaging the polymer film.

5. Tenter apparatus as claimed in claim 2, including means to position said belts into and out of engagement with the advancing web.

6. Apparatus of claim 5, including means to move said low friction plate support means out of the path of travel of the web in timed relationship with said means to position the belts.

7. Apparatus for advancing a continuous web of material comprising a pair of spaced endless belts disposed on opposite sides of a continuous web of material;

first and second pulley means for each of said belts defining belt lower runs;

means to advance said belt lower runs in the direction of travel of said web;

co-operating stationary low friction web support means on which the web edges ride, said web support means and belt lower runs pressing the web edges therebetween;

support means for each pair of pulley means including a first frame means extending from a pivot center to the first of said pulley means, and a second elongated frame means extending from the first of said pulley means to the second of said pulley means;

carrying means floatingly mounting the second frame means on said first frame means, said second frame means including a plate member conforming to said co-operating support and positioned between the upper and lower runs of said belt to exert a substantially uniform downward pressure along the length of said belt lower run, and means for limiting the downward pressure of said belt on said co-operating web support.

8. Web advancing apparatus as claimed in claim 7, wherein said pulley means includes a third pulley positioned with respect to the first and second pulley means to define a triangular path of travel for each endless belt;

said first frame means constituting a support for said third pulley in addition to the first of said pulley means;

9. Web advancing apparatus as claimed in claim 8, wherein said first frame means and second frame means define an acute angle with the first of the pulley means being the furthermost removed of the pulley means from said pivot center, further including:

means to pivot said first frame means about said pivot center.

10. Web advancing apparatus as claimed in claim 9 wherein said web is a synthetic polymer film, said belts having a rubber surface engaging said polymer film.

11. Tentering apparatus including a tentering machine having advancing tenter clips, and web advancing apparatus as claimed in claim 7 said web advancing apparatus being located before the tentering machine and serving to advance web material into the advancing tenter clips.

12. Web advancing apparatus as claimed in claim 11, wherein said low friction support means comprises a plurality of rolls at intervals spaced so as to co-operate with said endless belts.

13. Web advancing apparatus as claimed in claim 12, wherein said spaced rolls are slightly askew with respect to the direction of web advancement adapted to encourage movement of the web into engagement with said advancing tenter clips.

* * * * *